US007380662B2

(12) United States Patent
Olsthoorn

(10) Patent No.: US 7,380,662 B2
(45) Date of Patent: Jun. 3, 2008

(54) TRANSPORT CONTAINER FOR CUT FLOWERS, AND METHOD FOR THE ENCLOSURE OF CUT FLOWERS IN A PACKAGING

(75) Inventor: Boudewijn Hendrikus Maria Olsthoorn, Naaldwijk (NL)

(73) Assignee: Netherlands Bucket Company B.V., Maasland (NL)

( * ) Notice: Subject to any disclaimer, the term of this patent is extended or adjusted under 35 U.S.C. 154(b) by 467 days.

(21) Appl. No.: 10/891,684

(22) Filed: Jul. 14, 2004

(65) Prior Publication Data

US 2005/0044789 A1 Mar. 3, 2005

(30) Foreign Application Priority Data

Jul. 15, 2003 (NL) ..... 1023920
Nov. 19, 2003 (NL) ..... 1024813

(51) Int. Cl.
*A01G 5/00* (2006.01)

(52) U.S. Cl. ..... 206/423; 47/41.01

(58) Field of Classification Search ..... 206/423, 206/503, 505, 507, 514, 519; 47/65, 84, 47/72, 66.6, 65.8, 41.01, 41.1, 41.11, 41.15, 47/66.1, 39; 220/8

See application file for complete search history.

(56) References Cited

U.S. PATENT DOCUMENTS

| | | | | |
|---|---|---|---|---|
| 3,314,194 | A * | 4/1967 | Halleck | 47/69 |
| 4,291,493 | A * | 9/1981 | Monson | 47/14 |
| 4,936,046 | A * | 6/1990 | Miller | 47/41.01 |
| 5,060,799 | A * | 10/1991 | De Pagter | 206/423 |
| 6,474,017 | B1 * | 11/2002 | White | 47/41.01 |
| 6,752,270 | B1 * | 6/2004 | Helsloot et al. | 206/423 |
| 2003/0074835 | A1 * | 4/2003 | De Pagter et al. | 47/41.01 |

* cited by examiner

*Primary Examiner*—Mickey Yu
*Assistant Examiner*—Steven A. Reynolds
(74) *Attorney, Agent, or Firm*—Jeffrey D. Myers; Samantha A. Updegraff; Peacock Myers, P.C.

(57) ABSTRACT

A transport container for cut flowers includes at least one substantially watertight first container part (10) for receiving stems of cut flowers and a second container part (30), which at least during transport at least largely surrounds the cut flowers. The second container part includes a hollow base portion (20) which substantially receives the first container part on an upper surface thereof. The manually removable base portion (20) connects with a bottom of the second container part (30) and surrounds the cut flowers at least over a part of their length. Optionally, a collar element (40) is placed on the sleeve element.

21 Claims, 10 Drawing Sheets

TRANSPORT CONTAINER FOR CUT FLOWERS, AND METHOD FOR THE ENCLOSURE OF CUT FLOWERS IN A PACKAGING

CROSS-REFERENCE TO RELATED APPLICATIONS

This application claims priority to the following Dutch Patent Applications, namely Application No. 1023920 filed Jul. 15, 2003 and Application No. 1024813 filed Nov. 19, 2003, and the specifications thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to a transport container for cut flowers comprising at least one substantially watertight first container part for receiving the stems of cut flowers as well as a second container part, which at least during transport largely surrounds the cut flowers.

2. Description of Related Art

In order to keep cut flowers fresh during transport, they are preferably transported in water, especially in the case of long distances. It is in addition preferred to transport flowers in transport containers to protect the flowers against damage. This usually involves a transport container in the form of a cardboard box, on whose floor a watertight bucket is placed. The bucket constitutes a first container part and is filled with water for receiving the stems of the flowers. The box forms a second container part, whose height is adapted to the length of the flowers such that during transport they are concealed therein and protected against damage.

A drawback of this known transport container is that not infrequently water spills from the bucket into the packaging due to, for example, jolting and shaking during transport and transfer causing the cardboard packaging to soften at the expense of the stability of the packaging. In addition, the flowers have to be unpacked at their place of destination, which is not only time-consuming but also leaves much packaging waste.

Another problem is that the cut flowers may become damaged when the bucket with flowers is being placed into the packaging and when the bucket with the cut flowers is being taken out of the packaging. This is related to the long stems that cut flowers may have, so that during handling of the bucket the cut flowers may become spoiled.

BRIEF SUMMARY OF THE INVENTION

It is the object of the present invention to provide a transport container of the kind mentioned in the preamble, which removes these drawbacks.

In order to achieve the objective of the invention, a transport container of the kind mentioned in the preamble is, in accordance with the invention, characterised in that the second container part comprises a hollow base portion into which from an upper surface thereof, the at least one first container portion is substantially received, and in that the manually removable base portion at its upper surface is connected with a hollow container element extending from the upper surface of the base portion and able to surround the cut flowers at least over a part of their length. Such a transport container can be manufactured from any suitable material, in particular from plastic and will not lose its stability through contact with water. Since the transport container is composed of separate parts, the container may after use be taken apart and stored relatively compactly. The container may subsequently be reused and consequently produces less waste.

The base portion and the first container portion may be formed integrally, but in a preferred embodiment the transport container according to the invention is characterised in that the base portion is at its upper surface provided with an opening into which the removable at least one first container portion substantially exactly fits. More in particular, an embodiment of the transport container according to the invention is characterised in that the first container portion comprises a removable bucket, which is inserted into the base portion. By thus departing from a removable first container into which the stems of the cut flowers are inserted, the flowers can together with the first container be placed in the transport container and removed therefrom without the need of touching the flowers individually. This is not only an advantage for the condition of the flowers but it also saves time. In addition, after use the transport container can be dissembled into several parts and stored relatively compactly.

The base portion of the transport container according to the invention comprises a cavity for at least partly receiving the first container, but serves further to keep the first container securely in the upright position. With a view to economising on weight and material, a particular embodiment of the transport container according to the invention is characterised in that the base portion is all-round provided with walls hanging from the upper surface, portions of which are open. Experience has shown that base portions having walls with openings lose hardly any of their stability. The flowers lie still protected inside the first container and the sleeve portion of the transport container.

The transport container according to the invention is suitable for reuse. This means that in the case of transport from, for example, an auction to a retailer or end-user, the transport container has to be returned after use in order to be filled again. To keep the necessary return freight capacity low, a particular embodiment of the transport container according to the invention is characterised in that one or several of the base portion, the sleeve portion and the first container portion can, at least when empty, be nest-stored with a further base portion, sleeve portion and first container portion respectively. Thus, when empty, the various elements of the transport container can be put one inside the other and only take up little space. In a specific embodiment, the transport container is in this respect characterised in that one or several of the base portion, the sleeve portion and the first container portion at least cross-sectionally increase in width at least over their height. In that case the reduced ends of corresponding elements are pushed at least over part of their height into the wider end of another element.

In a further preferred embodiment the transport container according to the invention is characterised in that the sleeve portion is provided with a bottom having an opening in which the first container portion fits substantially exactly. In this case the first container portion is accessible from the sleeve portion and can be placed into the base portion or removed therefrom via the opening in the bottom of the sleeve portion. In this context a further particular embodiment of the transport container according to the invention is characterised in that the first container portion is at its top side provided with a sideways extending upper rim fitting over a rim of the opening in the bottom of the sleeve portion. In this case, the first container portion is advantageously removed from or replaced into the base portion by the same operation in which the sleeve portion is removed or positioned, respectively. This not only saves an extra operation, but also avoids unnecessary contact with the often fragile content.

The mutual removability between the various elements of the transport container as such may be realised in various ways. In a particularly practical embodiment, the transport container according to the invention is however characterised in that the base element and the sleeve element at an upper surface and a bottom, respectively, are provided with a longitudinal slot and a bayonet member inserted therein, the slot comprising a first portion releasing the bayonet member and a second portion locking the bayonet member, which portions lie in each other's extended direction. Such a bayonet coupling requires only a relatively simple and quick operation to realise the desired coupling or uncoupling between the portions. A further preferred embodiment of the transport container according to the invention is in this respect characterised in that the slot extends radially around a common central axis of the base portion and the sleeve portion wherein both the bayonet member and the longitudinal slot follow a radius. The bayonet coupling is then implemented and cancelled by a rotational movement around the central axis. Not only does this require no or very little extra space, but it can also be realised to be very secure and reliable.

In a further preferred embodiment, the transport container according to the invention is characterised in that the base element and the sleeve element can be stacked when filled due to the fact that the base element fits substantially exactly with a lower rim inside a top rim of a sleeve element of a further transport container. In general the length of cut flowers does not exceed a length of approximately 500-700 millimeters. In such cases the transport container does not need to be any higher. In order to make use of the available height in a loading or storage space, the transport container can in this embodiment be stacked so as to make optimal use of the height. In a particular embodiment the transport container is characterised in that the base element at its lower side is provided with a circumferential rib with which it rests on the top rim of the sleeve element. Thanks to this rib, a top transport container is prevented from dropping into a lower one, which could damage the cut flowers in the lower container.

A (basic) length of the sleeve element is adapted to the length of the cut flowers usually projecting from the first container element and thus requiring protection. In order to handle also longer cut flowers equally effectively, a further preferred embodiment according to the invention is characterised in that the sleeve element is at its top side provided with at least one manually removable collar element that may or may not be directly connected with the sleeve element. Such a collar element fits substantially exactly around the circumference of the transport container. By fitting one or several of these collar elements on the sleeve element, the sleeve element can be extended in accordance with the actual length of the cut flowers. This provides a particularly practical modular system that starts with identical first container elements, base elements and sleeve elements, optionally supplemented with collar elements that may actually also be uniform. The number of different components in the system can thus be kept to a relative limit, without losing its practical applicability. A particularly practical embodiment of the transport container according to the invention is in this connection characterised in that by way of a snap connection the collar element is coupled with the sleeve element so as to be manually removable.

A further preferred embodiment of the transport container according to the invention is characterised in that the sleeve element is provided with a plurality of collar elements, which like the manually removable coupling of a first collar element with the sleeve element, are coupled with each other so as to be manually removable. By thus for the mutual coupling of the collar elements employing a similar coupling as used for coupling a collar element with a sleeve element, all the collar elements can have a uniform design making them fully interchangeable.

A further embodiment of the transport container according to the invention is characterised in that each collar element has a height of approximately 10 centimeters. In this way the transport container can be gradually lengthened in steps of 10 centimeters, each which concurs with the increasing lengths of cut flowers. A further preferred embodiment of the transport container according to the invention is characterised in that the base element has a height of approximately 20-30 centimeters and the sleeve element approximately 300-400 millimeters, so that when stacked, they have a height of between approximately 500 and 700 millimeters. These dimensions concur with a basic length of cut flowers so that a major part of these can be immediately processed, with the height of the base elements being gauged to a desired height of the first container element. A further embodiment of the transport container according to the invention is characterised in that the base element and the sleeve element at least in a planar cross section are substantially rectangular and have a maximum outside dimension of approximately 400 by 300 millimeters. Although the base elements may be variously designed, optionally aesthetically inspired, a rectangular cross section as shown here affords an optimal packing efficiency and stability in a usually rectangular storage or loading space.

In a further preferred embodiment the transport container according to the invention is characterised in that the first container element comprises a standard bucket removably provided in the base element. With respect to the first container element this concerns a standard bucket as used in the above-described conventional transport container. In that case the transport container according to the invention can be implemented in an existing environment without leading to a significant disinvestment.

The invention is also embodied in a method for receiving cut flowers in a packaging, wherein the cut flowers are placed into a container and the container with the cut flowers is placed into the packaging. The invention further relates to a base element, a sleeve element, collar element or first container element for use in the above-described transport container.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

The figures are not always drawn to the same scale. Similar components in the figures are as much as possible identified with identical reference numerals.

DETAILED DESCRIPTION OF THE INVENTION

Figure 1:
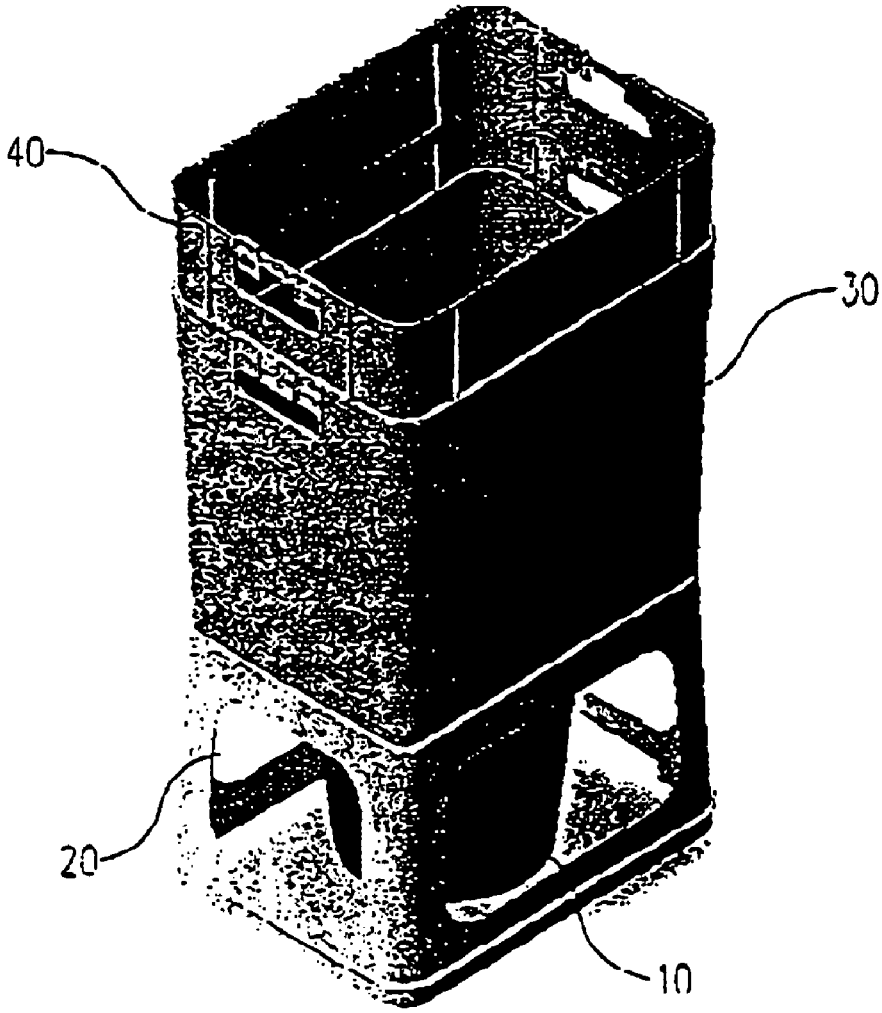
FIG. 1 shows a transparently illustrated perspective view of an embodiment of a transport container according to the invention.

The embodiment of a transport container according to the invention shown in FIG. 1, comprises a first container element 10 in the form of a standard bucket as typically used in existing wet-packaging of flower. The first container element is almost entirely contained in a base element 20 of the transport container, which at an upper surface is provided with a sleeve element 30. The upper surface of the base element and a bottom of the sleeve element are provided with an opening into which the bucket 10 fits substantially exactly. The sleeve element (hollow container element) 30 is hollow and affords protection to cut flowers whose stems are inserted into the first container element 10 but extend beyond the same. For longer cut flowers, the sleeve element 30 is in this embodiment extended by means of a collar element 40 fastened thereto by means of snap connection so as to be manually removable. The various components of the transport container are made from a shock-prove plastic. Especially suitable for this is an injection moulding process with which the various components can be integrally formed.

Figure 2:
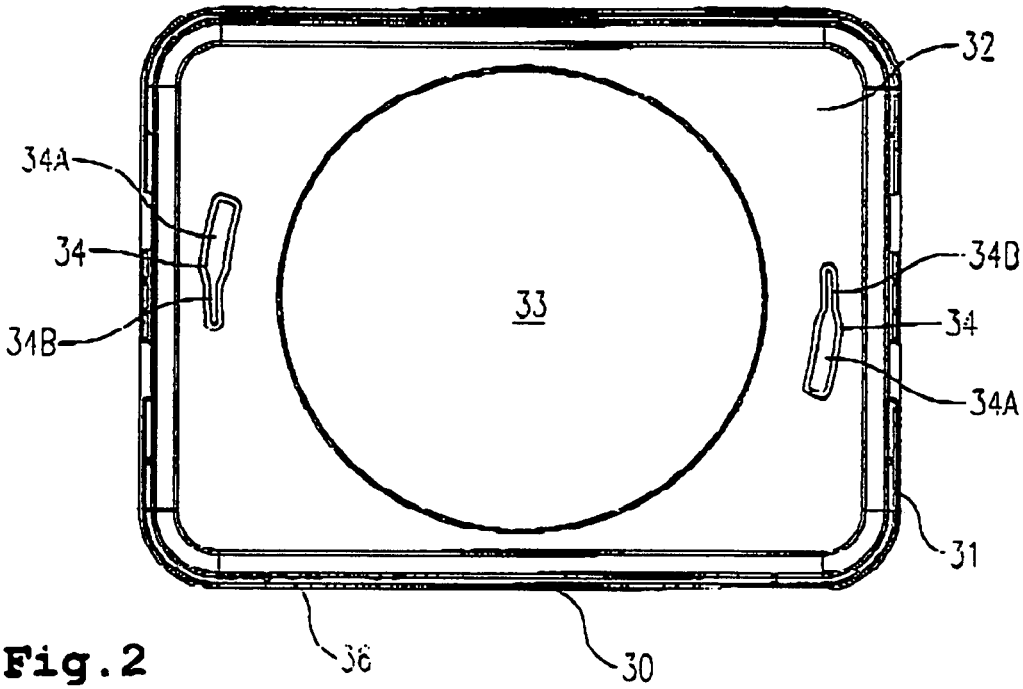
FIG. 2 shows a top view of the sleeve element of the transport container of FIG. 1 to be used a packaging.

In a top view in FIG. 2, the sleeve element of the transport container of FIG. 1 is shown in more detail. The sleeve element is integrally formed from a suitable plastic by means of injection moulding. A typical height for the sleeve element 30 is approximately 300-400 millimeters, gauged to an average length of cut flowers. At its top side the sleeve element measures approximately 300 by 400 millimeters and is all round provided with solid walls 31 extending from a bottom 32 and slightly widening. The bottom is provided with a central opening 33 accommodating a bucket 10. The opening further comprises two bayonet slots 34, each having a relatively wide first portion 34A and a narrower second portion 34B. The two longitudinal slots 34 extend radially around an imaginary central axis of the sleeve element, which stands perpendicularly on the plane of the drawing of FIG. 2.

Figure 3:
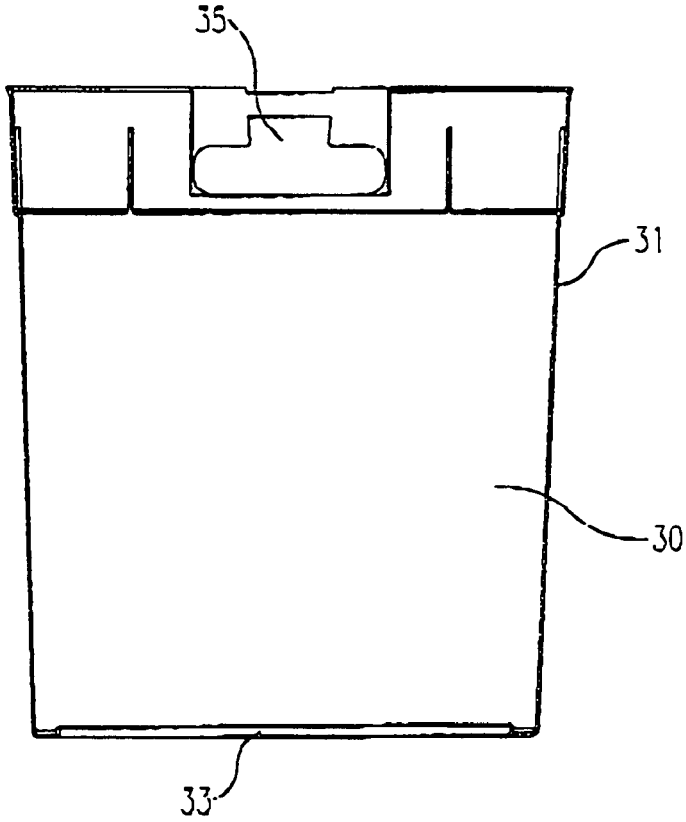
FIG. 3 shows a first side elevation of the sleeve element of the transport container of FIG. 1.
Figure 10:
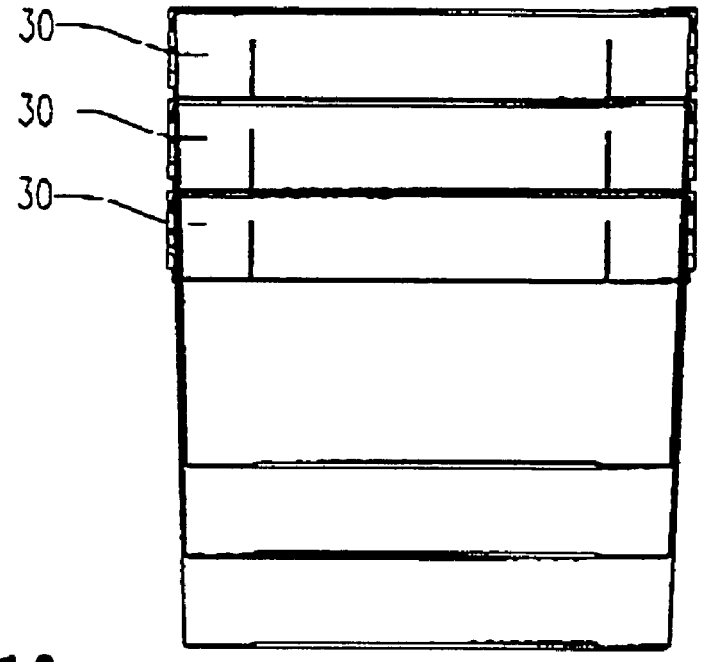
FIG. 10 shows in cross section a stack of empty sleeve elements.

FIG. 3 shows a side elevation of the sleeve element 30. At a top side, the sleeve element 30 is at both sides provided with handgrips 35 for easy lifting of the unit. Viewed in cross section, the walls 31 of the sleeve element have a slightly conical or tapering, substantially reducing form to allow the sleeve element 30 when empty to be nest-stored with a similar further sleeve element, as shown in FIG. 10. This allows unused empty sleeve elements to be stored relatively compactly or to be returned.

Figure 4:
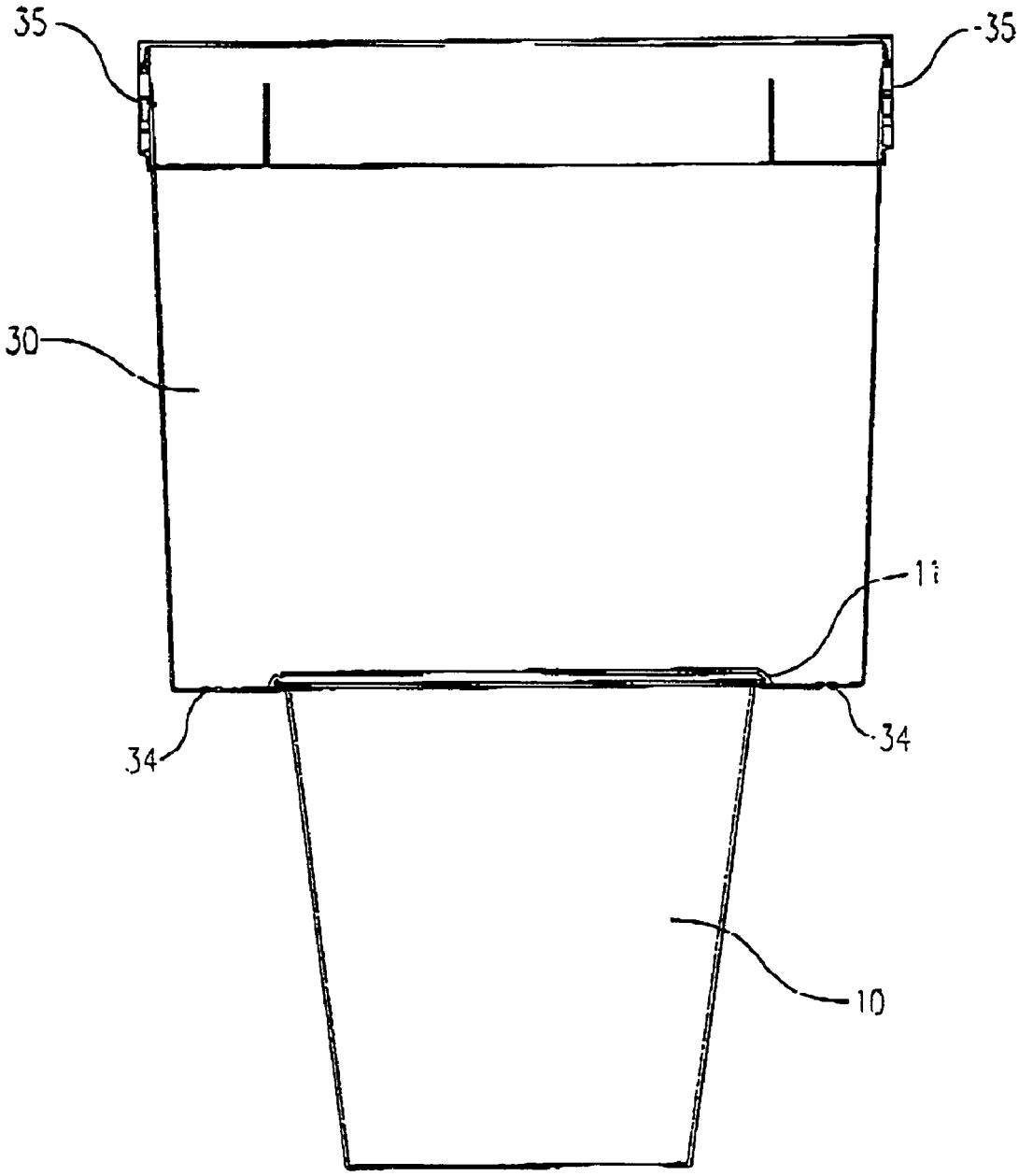
FIG. 4 shows a second side elevation of the sleeve element of the first container element of the transport container of FIG. 1.

At a top side the bucket 10 is provided with a sideways extending rim 11 fitting over the rim of the opening 33 in the sleeve element 30, see FIG. 4. The rim 11 of the bucket 10 thus rests on the bottom 32 of the sleeve element 30 and the bucket 10 together with the sleeve element 30 can be lifted in one movement from the base element 20 of the transport container. The bucket fits substantially exactly into the opening 33.

Figure 5:
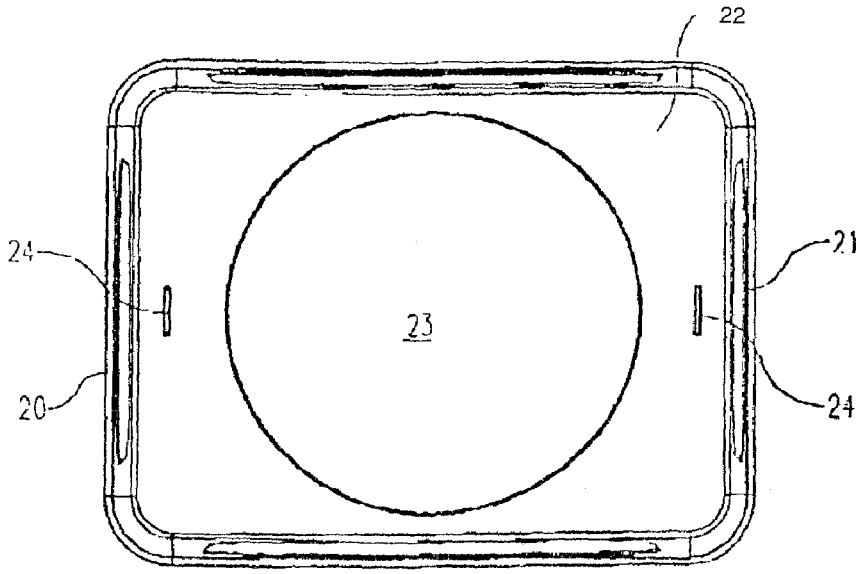
FIG. 5 shows a top view of the base element of the transport container of FIG. 1.
Figure 6:
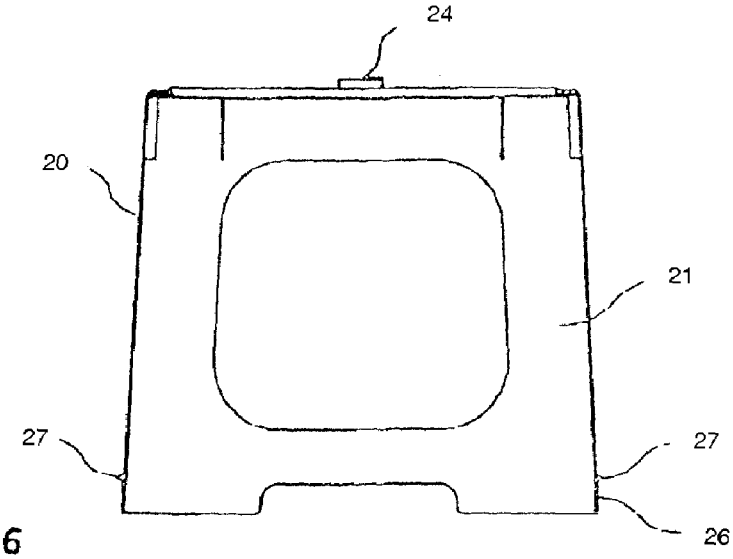
FIG. 6 shows a first side elevation of the base element of the transport container of FIG. 1.
Figure 11:
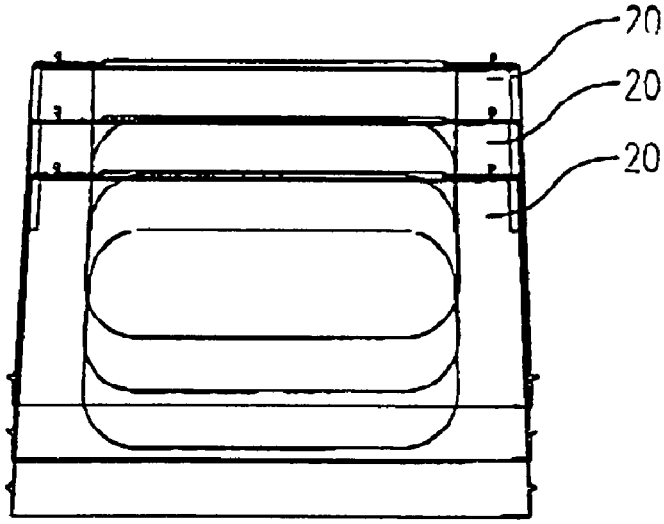
FIG. 11 shows in cross section a stack of empty base elements.

In FIG. 5 and 6, the base element 20 of the transport container is shown in more detail in a top view and side elevation respectively. The base element 20 as well as the sleeve element 30 are integrally formed from plastic by injection moulding. The base element 20 has, at least viewed from the side, a slightly conical, substantially reduced shape so that it can be nest-stored with a similar base element, as further shown in FIG. 11. The base element has a height of approximately 250 millimeters and measures approximately 300 by 400 millimeters at its base.

Around the base element 20, open walls 21 are provided hanging from an upper surface 22. In the centre, the upper surface 22 is provided with a round opening 23 to allow access to the bucket 10 when the same is being placed into the base element. In addition, the upper surface comprises two bayonet members 24 that correspond with the bayonet slots 34 in the sleeve element. Both the bayonet members 24 comprise raised longitudinal ribs that start at the upper surface 22 and project into the slots 34. At their free end, the thickness of the longitudinal ribs is crossways increased, see FIG. 8, and project with this thickened end beyond the bottom 32 of the sleeve element 30. Like the slots, the longitudinal ribs 24 follow an imaginary radius around a central axis of the unit. When assembled, see FIGS. 1 and 8, the ribs 24 are in the narrow portion 34B of the respective bayonet slots 34 and are the ribs enclosed therein. The whole is then coupled together. By now making a small rotational movement with the sleeve element 30 in relation to the base element 20, the ribs 24 slide from the relatively narrow portion 34B of the slots 34 to the relatively wide portion 34A so as to release them. In this situation, the sleeve element 30 may be lifted from the base element 20, taking the bucket 10 with it.

Figure 7:
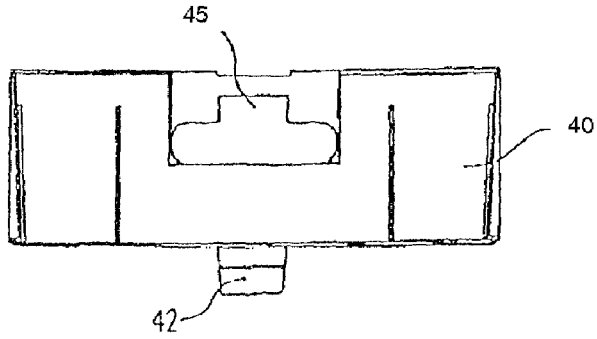
FIG. 7 shows a first side elevation of the collar element of the transport container of FIG. 1.
Figure 8:
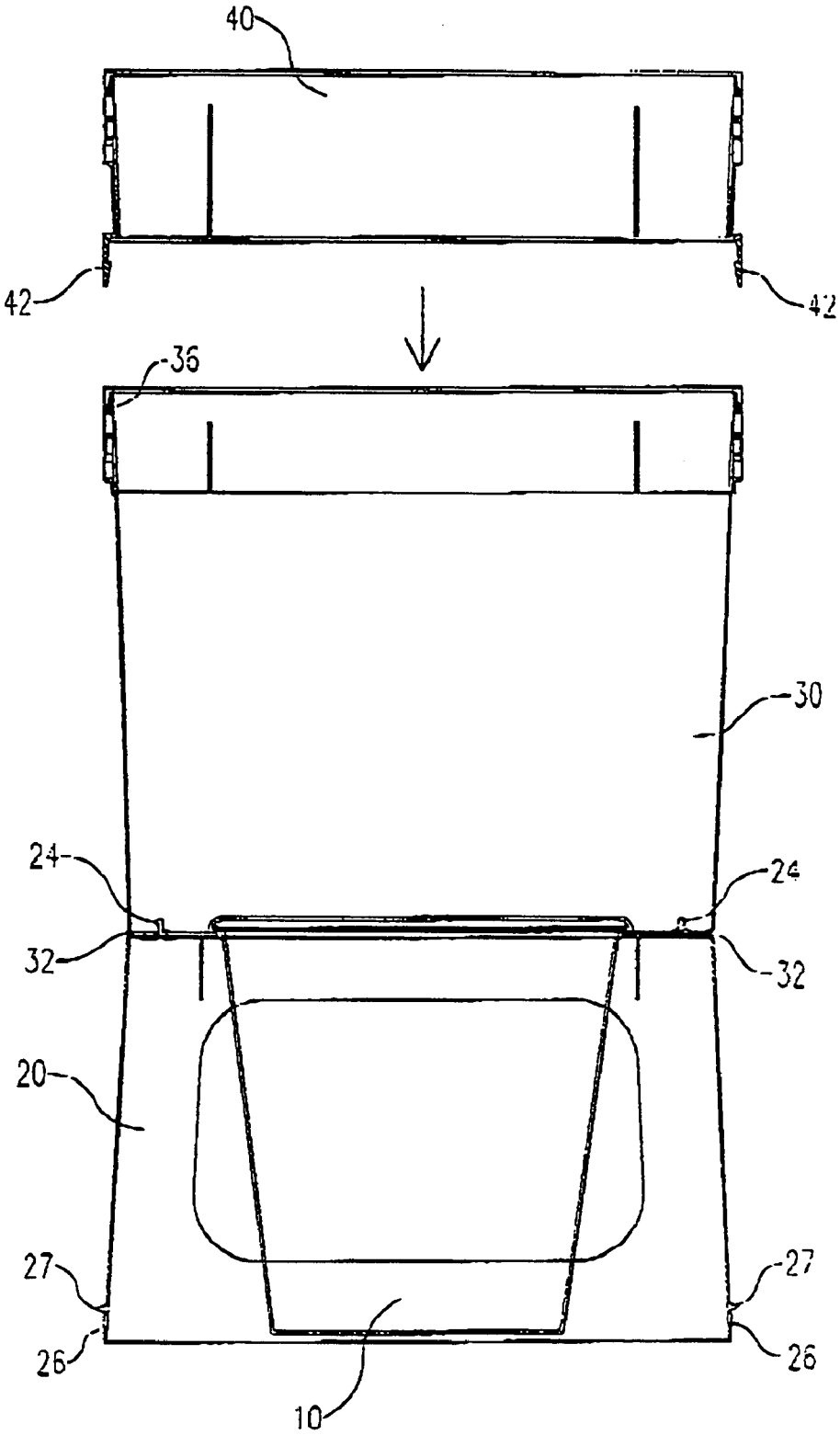
FIG. 8 shows in a second side elevation the transport container of FIG. 1.

In order to lengthen the sleeve element, a collar element 40 is placed thereon, shown in FIGS. 7 and 8 in relative orthogonal side elevations. The collar element follows the circumference of the sleeve element 30 and provides a virtually seamless fit. In order to facilitate the coupling between the collar element 40 and the sleeve element, the collar element is at both sides provided with snap members 42 projecting therefrom. The snap members in the handgrips 35 snap into the sleeve element 30 so that both elements can be simply snap-connected, see FIG. 8. The collar elements in their turn are at their opposite side provided with the same, or similar handgrips 45 as the sleeve elements 30, so that the collar elements can also be mutually coupled. In this example the collar elements have a height of approximately 10 centimetres so that the unit can be extended in steps of 10 centimetres.

Figure 9:
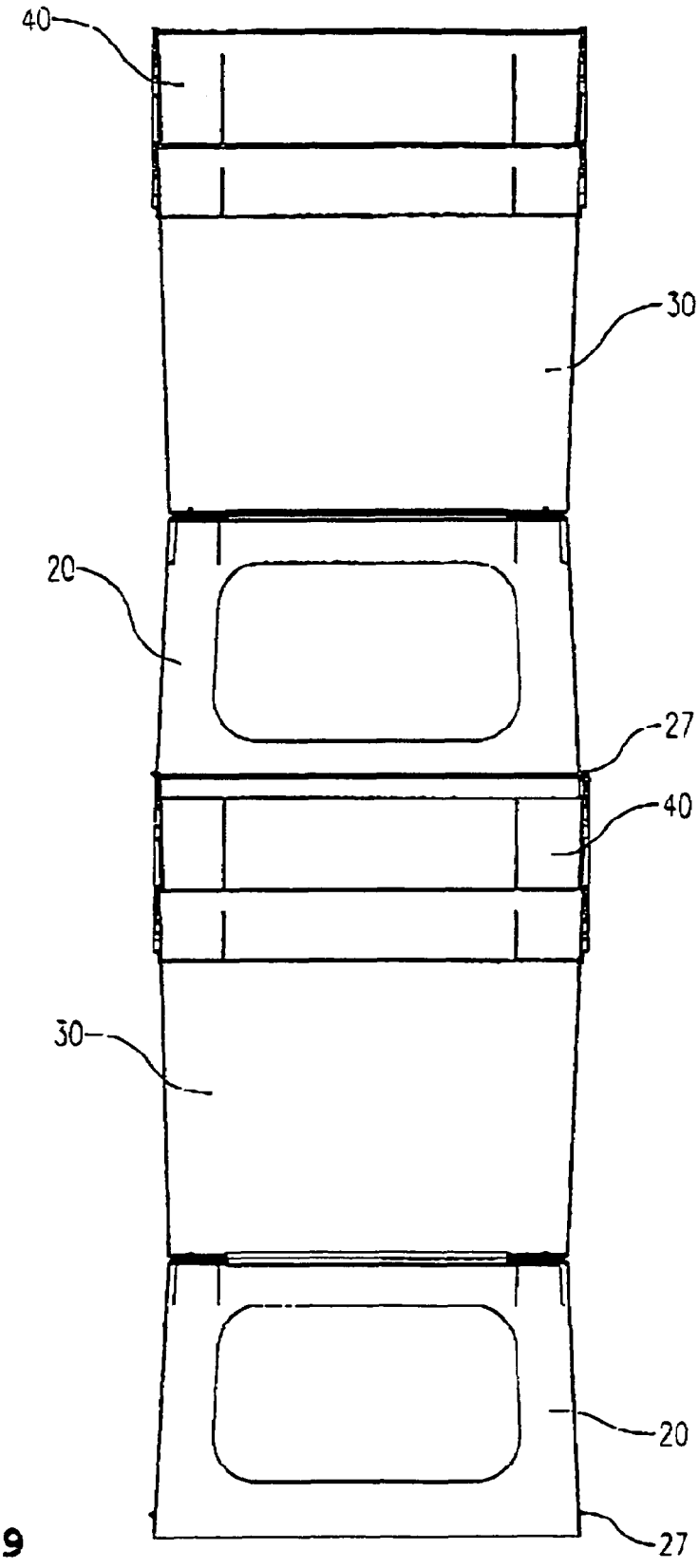
FIG. 9 shows in cross section a stack of the transport container of FIG. 1.

A bottom rim 26 of the base element 20 falls inside a top rim 36, 46 of a sleeve element 30, or as the case may be, a collar element 40 of a further transport container, allowing the transport container in the filled condition to be stacked, see FIG. 9. In order to avoid that a top transport container slides too far, or askew, into a transport container underneath it whereby it could damage the flowers accommodated therein, the base elements 20 are at their bottom side provided with a circumferential rib 27 with which a base element rests upon a top rim of the transport container underneath. This provides a particularly stable stack.

Although the invention was elucidated by way of only one single exemplary embodiment, it will be clear that the invention is in no way limited to the described exemplary embodiment. On the contrary, a person skilled in the art will be able to conceive of many variations and forms without departing from the scope of the invention. For example, the sizes, the materials used and the design of the various elements may be modified as desired. Also, the invention may be used without collar element or with even more collar elements. The invention always affords a particularly practical, flexible, widely employable and reusable transport medium for cut flowers.

A special aspect is that the invention is also embodied in a method for receiving cut flowers in a packaging, wherein the above-elucidated transport container serves as packaging. To explain this method, reference is first made to FIG. 2 in which a top view of a sleeve element 30 is shown, which is provided with a bottom 32 in which an opening 33 is provided in the bottom side. The sleeve element 30 also has an opening in the top side, which is defined by the preferably solid walls 31 of the sleeve element 30. The diameter of the bottom opening 33 is such that it can interact with a container rim 11 of the container 10 for the cut flowers, as will be readily appreciated from the cross-sectional view shown in FIG. 12.

Figure 12:
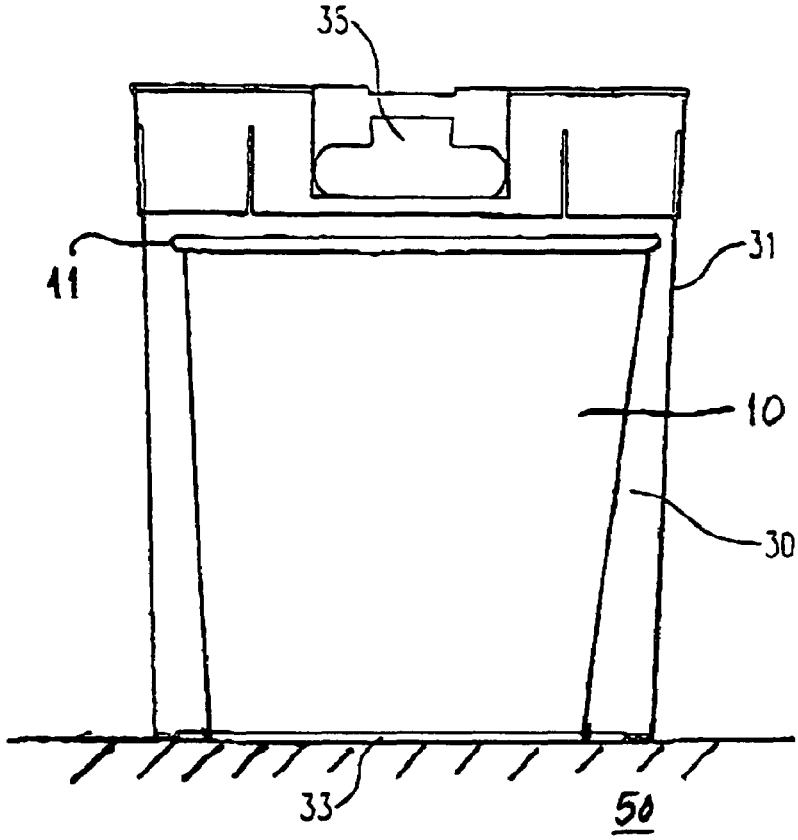
FIG. 12 shows a cross-sectional view of the sleeve element shown in FIG. 1 together with the container for the cut flowers placed therein.

FIG. 12 shows that the sleeve element 30 is at its top side provided with handgrips 35 by which this sleeve element can be lifted. In such a situation, first the bottom side of the sleeve element 30 lifts off a floor 50 upon which the same rests, while the container 10 with the cut flowers placed therein (not shown) initially remains on said floor 50 due to the container bottom being able to reach through the bottom opening 33 of the sleeve element 30.

Figure 13:
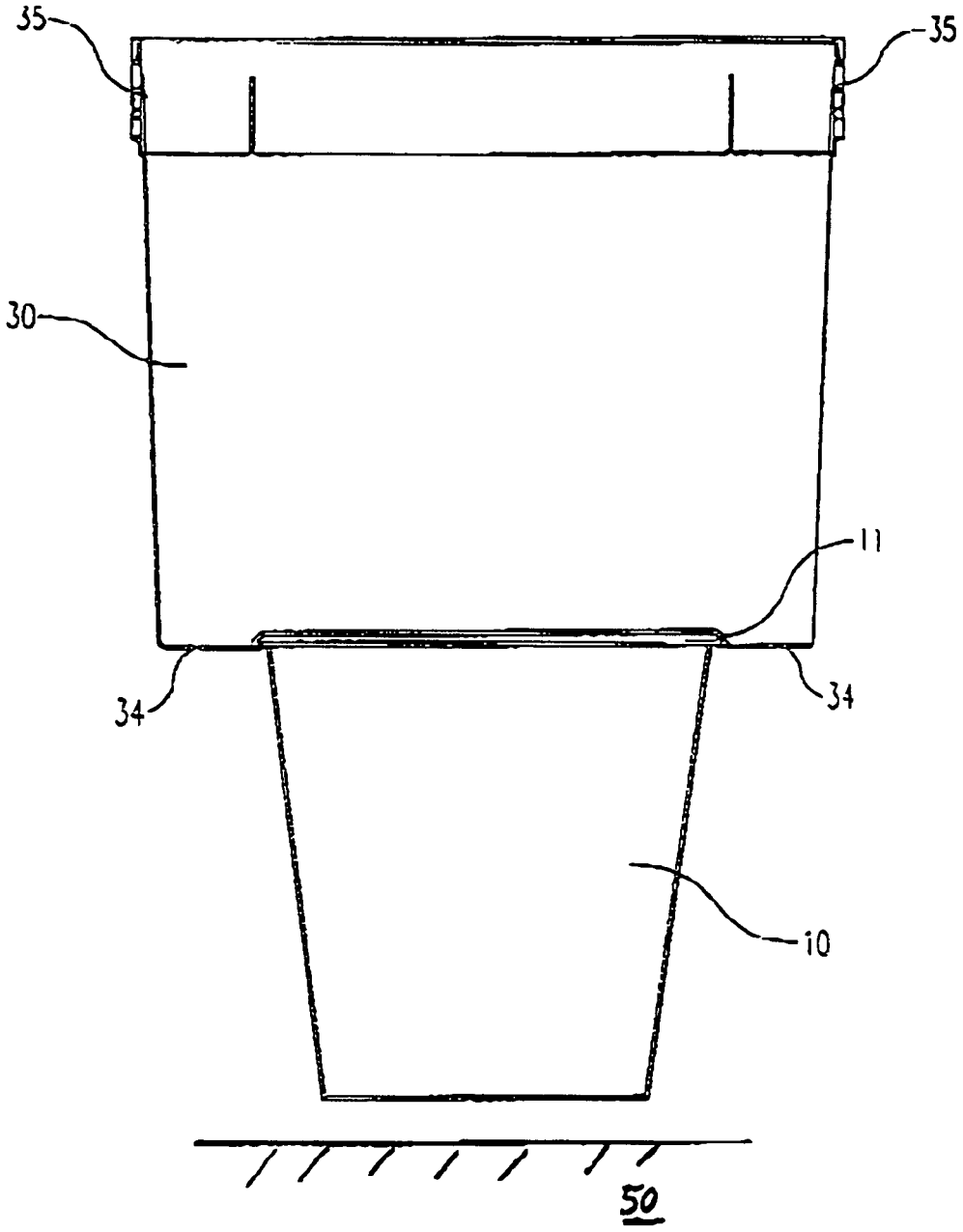
FIG. 13 shows a front view of the sleeve element with the container for cut flowers hanging therefrom.

Further lifting of the sleeve element 30 such that the container rim 11 becomes interactive with the bottom opening 33 in the floor 34 of the sleeve element 30, also causes the container 10 for the cut flowers to be lifted off the floor 50. This is shown in FIG. 13.

Figure 14:
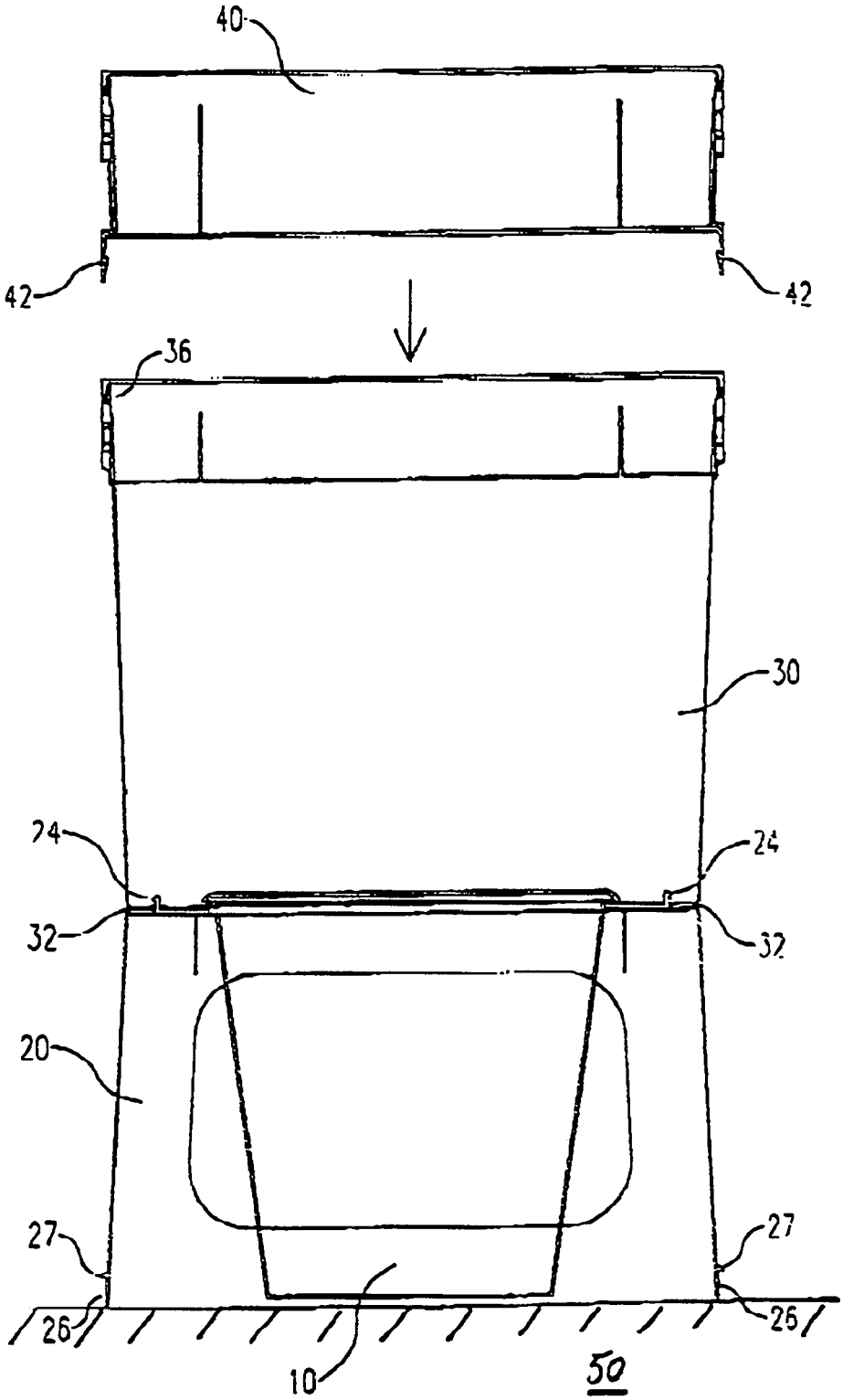
FIG. 14 shows the ready-for-use packaging for the cut flowers.

FIG. 14 finally shows that the sleeve element 30 with the container 10 for the cut flowers is placed on the base element 20, thereby completing the packaging for transport of cut flowers. FIG. 14 further shows that optionally an extension element 40 may be placed on the sleeve element 30 so as to increase the height of the sleeve element 30 in case especially long cut flowers need to be transported.

It will be clear that in the above-elucidated method according to the invention the cut flowers that are placed in the container 10 receive protection because the container 10 is not handled directly, but indirectly due to the interposition of the sleeve element 30 by which the container 10 is lifted off the floor and placed on the base element 20, to form the ready-to-use packaging. This advantage also benefits the removal of the cut flowers from the packaging. In that situation again the sleeve element 30 is handled to remove said sleeve element 30 with the container 10 holding the cut flowers from the base element 20 (see FIG. 14). Subsequently the sleeve element 30 with the container 10 can be placed on the floor 50 as shown in FIG. 12, such that both the sleeve element 30 and the container 10 come to rest on said floor 50. The cut flowers are now ready for removal from the container 10, without the necessity of any direct contact with the cut flowers.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A transport container for cut flowers comprising at least one substantially watertight first container part (10) for receiving stems of cut flowers as well as a second container part, which at least during transport at least largely surrounds the cut flowers, wherein the second container part comprises a hollow container element (30) and a hollow base portion (20) supporting said container element (30), wherein said container element (30) includes a bottom (32) having an opening (33) adapted to hold a rim (11) of the first container portion (10), and wherein the base portion (20) includes an upper surface (22) having an opening (23) for receiving the at least one first container portion (10), and wherein said opening (23) at the upper surface of the base portion (20) substantially exactly fits the at least one first container portion (10).

2. A transport container according to claim 1, wherein the first container part (10) comprises a removable bucket, which is inserted into the base portion (20).

3. A transport container according to claim 1, wherein the base portion is all round provided with walls hanging from the upper surface, portions of which are open.

4. A transport container according to claim 1, wherein one or several of the base portion, the hollow container element and the first container part can, at least when empty, be nest-stored with a further base portion, hollow container element and first container part respectively.

5. A transport container according to claim 4, wherein one or several of the base portion, the hollow container element and the first container part at least cross-sectionally increase in width at least over their height.

6. A transport container according to claim 1, wherein the first container portion fits substantially exactly in the opening in the bottom of the container element.

7. A transport container according to claim 6, wherein the first container part is at its topside provided with a sideways extending upper rim fitting over a rim of the opening in the bottom of the hollow container element.

8. A transport container according to claim 1, wherein the base element and the hollow container element at an upper surface and a bottom, respectively, are provided with a longitudinal slot and a bayonet member inserted therein, the slot comprising a first portion releasing the bayonet member and a second portion locking the bayonet member, which portions lie in each other's extended direction.

9. A transport container according to claim 8, wherein the slot extends radially around a common central axis of the base portion and the hollow container element wherein both the bayonet member and the longitudinal slot follow a radius.

10. A transport container according to claim 1, wherein the base element and the hollow container element can be stacked when filled due to the fact that the base element fits substantially exactly with a lower rim inside a top rim of a hollow container element of a further transport container.

11. A transport container according to claim 10, wherein the base element at its lower side is provided with a circumferential rib with which it rests on the top rim of the hollow container element.

12. A transport container according to claim 1, wherein the hollow container element is at its topside provided with at least one manually removable collar element that may or may not be directly connected with the hollow container element.

13. A transport container according to claim 12, wherein byway of a snap connection the collar element is coupled with the hollow container element so as to be manually removable.

14. A transport container according to claim 12, wherein the hollow container element is provided with a plurality of collar elements, which are coupled with each other so as to be manually removable.

15. A transport container according to claim 12, wherein each collar element has a height of approximately 10 centimetres.

16. A transport container according to claim 1, wherein the base element has a height of approximately 20-30 centimetres and the hollow container element approximately 300-400 millimetres, so that when stacked, they have a height of between approximately 500 and 700 millimetres.

17. A transport container according to claim 1, wherein the base element and the hollow container element at least in a planar cross section are substantially rectangular and have a maximum outside dimension of approximately 400 by 300 millimetres.

18. A transport container according to claim 1, wherein the first container part comprises a removable standard bucket, which is accommodated in the base portion.

19. A transport container for cut flowers comprising at least one substantially watertight first container part (10) for receiving stems of cut flowers as well as a second container part, which at least during transport at least largely surrounds the cut flowers, wherein the second container part comprises a hollow container element (30) and a hollow base portion (20) supporting said container element (30), wherein said container element (30) includes a bottom (32) having an opening (33) adapted to hold a rim (11) of the first container part (10), wherein the base portion (20) is at its upper surface provided with an opening into which the removable at least one first container part (10) substantially exactly fits, wherein the base portion and the hollow container element at an upper surface and a bottom, respectively, are provided with a longitudinal slot and a bayonet member inserted therein, the slot comprising a first portion releasing the bayonet member and a second portion locking the bayonet member which portions lie in each other's extended direction.

20. A transport container according to claim 19, wherein the slot extends radially around a common central axis of the base portion and the hollow container element wherein both the bayonet member and the longitudinal slot follow a radius.

21. A transport container for cut flowers comprising at least one substantially watertight first container part (10) for receiving stems of cut flowers as well as a second container part, which at least during transport at least largely surrounds the cut flowers, wherein the second container part comprises a hollow container element (30) and a hollow base portion (20) supporting said container element (30), wherein said container element (30) includes a bottom (32) having an opening (33) adapted to hold a rim (11) of the first container part (10), and wherein the base portion (20) includes an upper surface (22) having an opening (23) for receiving the at least one first container portion (10), wherein the hollow container element is at its topside provided with at least one manually removable collar element that may or may not be directly connected with the hollow container element, and wherein the hollow container element is provided with a plurality of collar elements, which are coupled with each other so as to be manually removable.

* * * * *